US007581975B1

(12) United States Patent
Liu et al.

(10) Patent No.: US 7,581,975 B1
(45) Date of Patent: Sep. 1, 2009

(54) FLEXIBLE PRINTED CIRCUIT CONNECTOR

(75) Inventors: Yun Xian Liu, Tu-Cheng (TW); Yin Lung Wu, Tu-Cheng (TW); Ming Chiang Chen, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/314,285

(22) Filed: Dec. 8, 2008

(51) Int. Cl.
*H01R 13/15* (2006.01)

(52) U.S. Cl. ..... 439/260

(58) Field of Classification Search ..... 439/495, 439/60, 635, 909
See application file for complete search history.

(56) References Cited

U.S. PATENT DOCUMENTS 5,816,845 A * 10/1998 Chishima et al. ..... 439/495
6,159,038 A * 12/2000 Wu ..... 439/495
7,025,613 B2 * 4/2006 Satou ..... 439/260

* cited by examiner

*Primary Examiner*—Phuong K Dinh
(74) *Attorney, Agent, or Firm*—Rosenberg, Klein & Lee

(57) ABSTRACT

A flexible printed circuit connector includes a base insulator, a plurality of electrical terminals fixed in the base insulator and a slide insulator slidably mounted to the base insulator. The base insulator has a bottom board and two opposite sidewalls. Each sidewall defines a sliding recess at an outside thereof. Each of the electrical terminals has an elastic contact portion located above the bottom board for allowing an FPC to be inserted therebetween. The slide insulator has a cover and two flanks at two opposite sides of the cover. Each of the flanks defines a slide block at an inner side thereof for relatively sliding in the sliding recess. The cover is capable of pressing the elastic contact portions downwardly to make the elastic contact portions stably electrically connected with the FPC by a relative slide between the slide insulator and the base insulator.

2 Claims, 6 Drawing Sheets

FLEXIBLE PRINTED CIRCUIT CONNECTOR

BACKGROUND OF THE INVENTION

1. Field of the Invention

The present invention relates to an electrical connector, and more particularly to a flexible printed circuit connector.

2. The Related Art

A conventional flexible printed circuit connector includes an insulating housing, a plurality of terminals received in the insulating housing and an actuator. The insulating housing defines an insertion slot for receiving a flexible printed circuit (FPC). The actuator has a shaft portion pivotally mounted to the insulating housing. When the FPC is inserted into the flexible printed circuit connector, the actuator will rotate around the shaft portion to press against the FPC for establishing electrical connection between the terminals and the FPC.

However, because of the limitation of the conventional flexible printed circuit connector, the dimension and strength of the shaft portion is difficult to be enlarged, then the shaft portion of the actuator would likely to break off during the rotation of the actuator, and as a result, the flexible printed circuit connector will work at an unstable status.

SUMMARY OF THE INVENTION

An object of the present invention is to provide a flexible printed circuit connector adapted for being electrically connected with an FPC stably. The flexible printed circuit connector includes a base insulator, a plurality of electrical terminals fixed in the base insulator and a slide insulator slidably mounted to the base insulator. The base insulator has a bottom board, a rear wall and two opposite sidewalls respectively extending upwardly from the bottom board. The rear wall defines plural receiving grooves. Each of the sidewalls defines a sliding recess at an outside thereof. The electrical terminals are mounted in the corresponding receiving grooves. Each of the electrical terminals has an elastic contact portion located above the bottom board for allowing the FPC to be inserted therebetween. The slide insulator has a cover and two flanks at two opposite sides of the cover. Each of the flanks defines a slide block at an inner side thereof for relatively sliding in the sliding recess. The cover is capable of pressing the elastic contact portions downwardly to make the elastic contact portions stably electrically connected with the FPC by a relative slide between the slide insulator and the base insulator.

As described above, by virtue of the slide blocks of the slide insulator relatively sliding in the sliding recesses of the base insulator, the cover is capable of pressing the elastic contact portions of the electrical terminals downwardly to make the elastic contact portions electrically connected with the FPC. Thus, the FPC is fixed between the elastic contact portions and the bottom board firmly, and therefore, the electrical connection between the flexible printed circuit connector and the FPC is stable.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
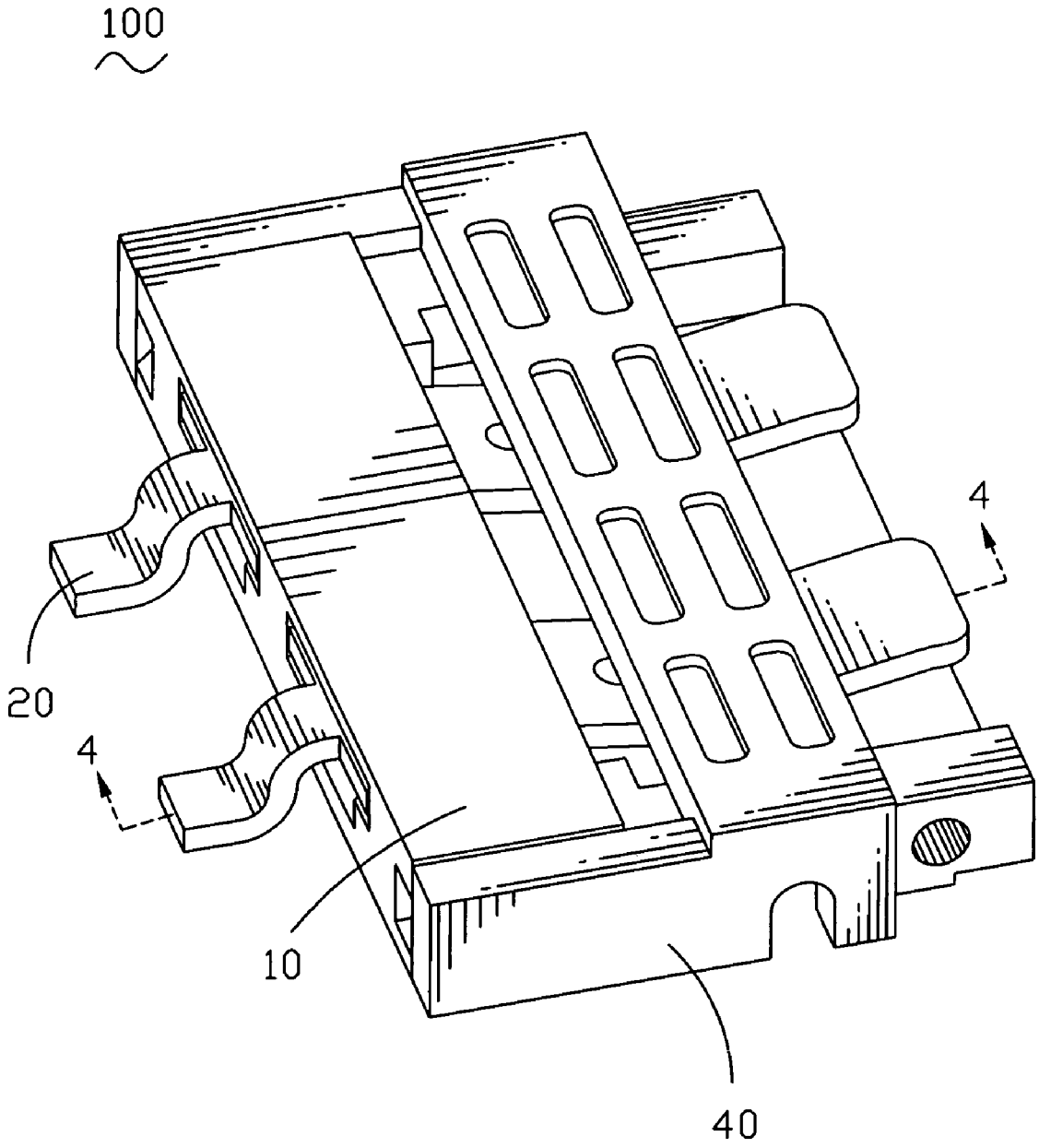
FIG. 1 is a perspective view of a flexible printed circuit connector in accordance with the present invention.
Figure 2:
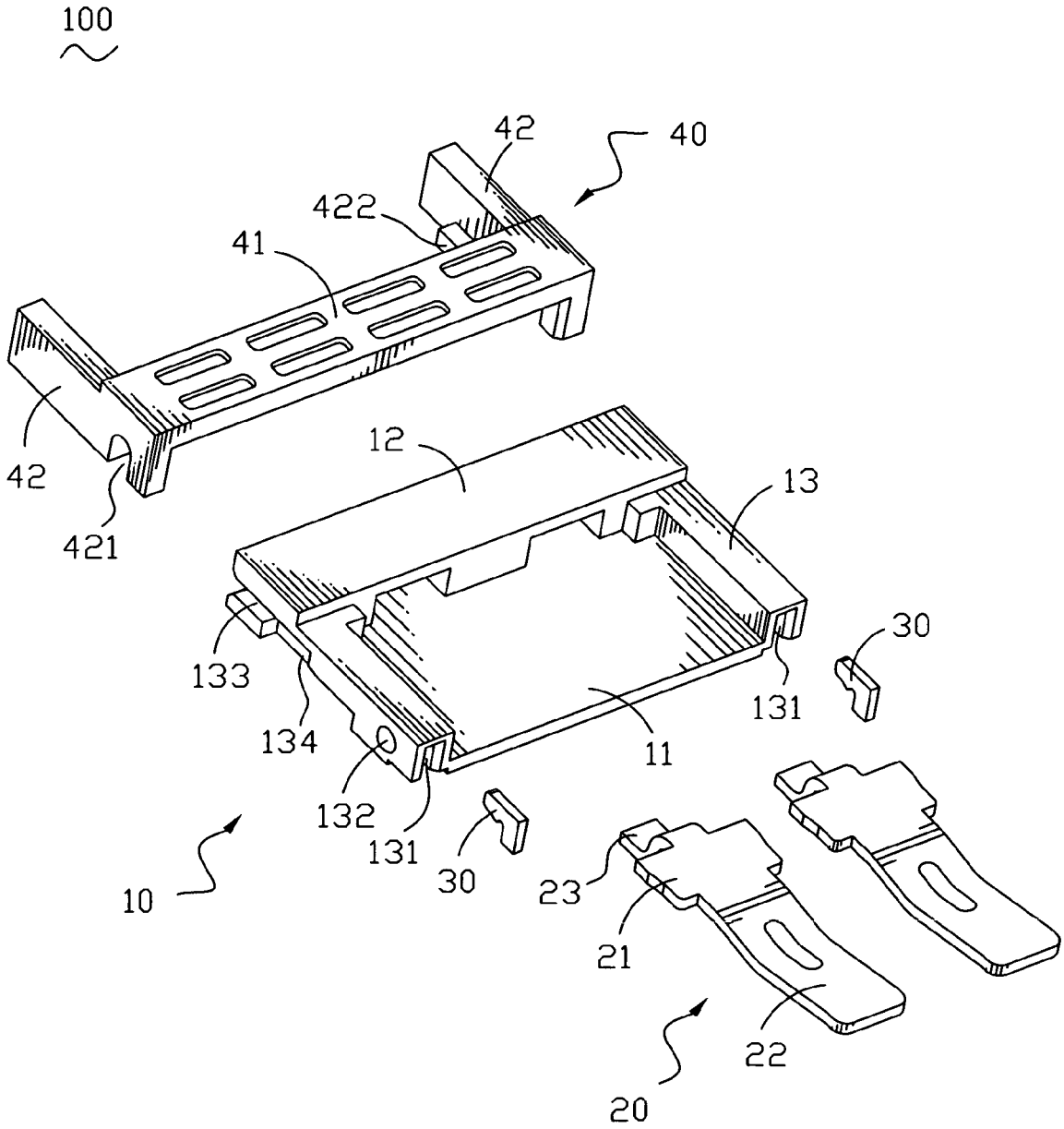
FIG. 2 is an exploded view of the flexible printed circuit connector.

With reference to FIG. 1, a flexible printed circuit connector 100 according to the invention includes a base insulator 10, a pair of electrical terminals 20 fixed to the base insulator 10, a pair of solder pads 30 (as shown in FIG. 2) embedded into two opposite sides of the base insulator 10 and a slide insulator 40 slidably mounted to the base insulator 10.

Figure 3:
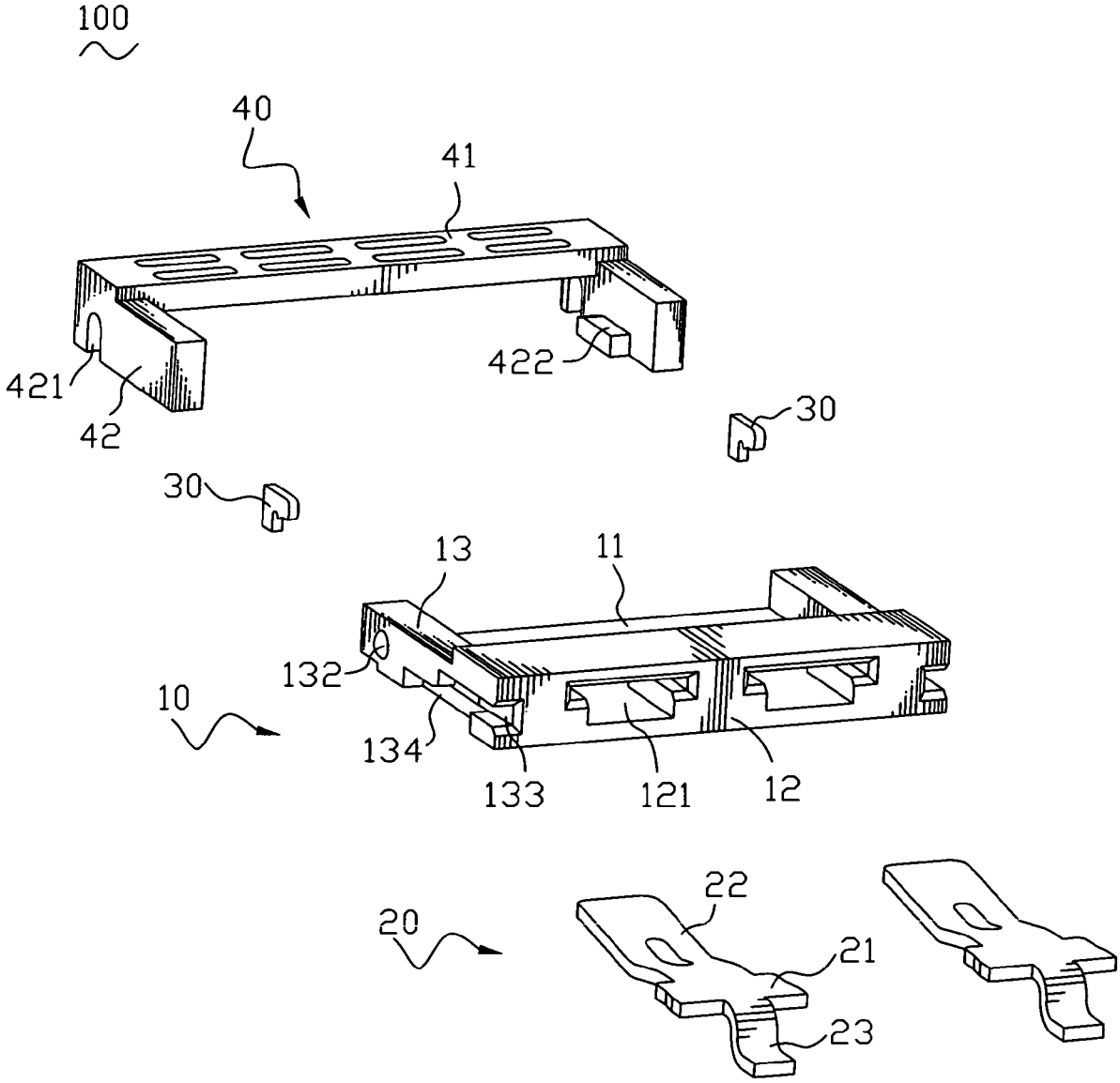
FIG. 3 is another angle exploded view of the flexible printed circuit connector.
Figure 4:
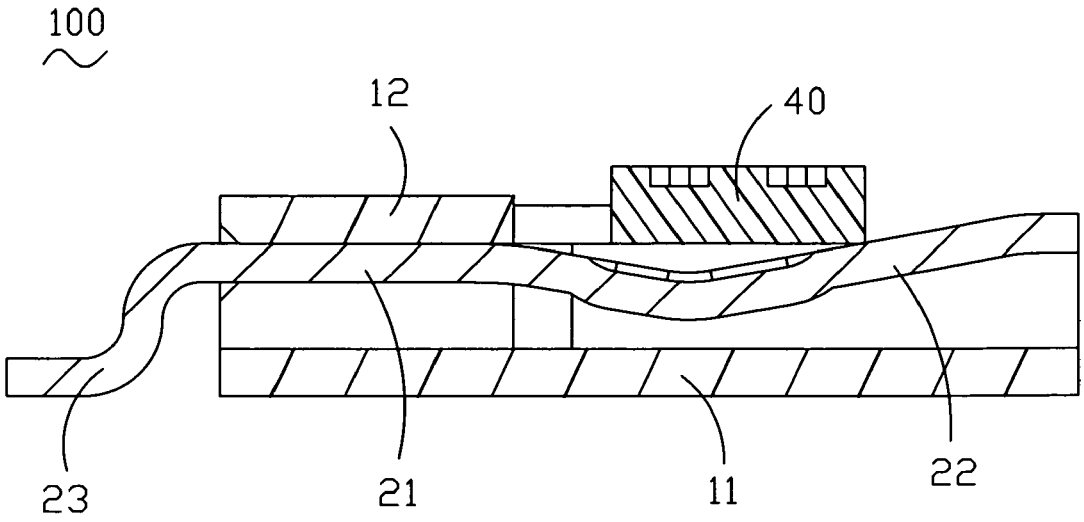
FIG. 4 shows a cross-sectional view of the flexible printed circuit connector in FIG. 1 taken along line 4-4.

Referring to FIGS. 2 and 3, the base insulator 10 has a bottom board 11, a rear wall 12 and two opposite sidewalls 13 respectively extending upwardly from the bottom board 11. The rear wall 12 defines two receiving grooves 121 penetrating therethrough from front to rear for correspondingly fixing the electrical terminals 20. Each of the sidewalls 13 defines an insertion cavity 131 extending rearward from a front end thereof for correspondingly receiving the solder pads 30 therein. Adjacent to the front end of each sidewall 13, a substantially semi-spherical projection 132 protrudes outward from an outer side of the sidewall 13. The base insulator 10 further defines a guide passage 133 at a rear end of each of the sidewalls 13 and a sliding recess 134 at a lower portion of each of the sidewalls 13. The sliding recess 134 communicates with the guide passage 133.

Each of the electrical terminals 20 has a substantially rectangular fixed portion 21. A front end of the fixed portion 21 extends forward and downwardly then bends upwardly slightly to form an elastic contact portion 22. A weld portion 23 bends downward and then extends rearward from a middle portion of a rear end of the fixed portion 21.

The solder pad 30 is of a substantially inversed L-shaped structure. The slide insulator 40 has a cover 41 showing a substantially rectangular shape. Two opposite sides of the cover 41 extend downwardly and then extend rearward to form a flank 42 respectively. Each flank 42 is provided with an arc locking gap 421 at a front portion thereof and a slide block 422 at a lower portion of an inner side thereof.

Figure 5:
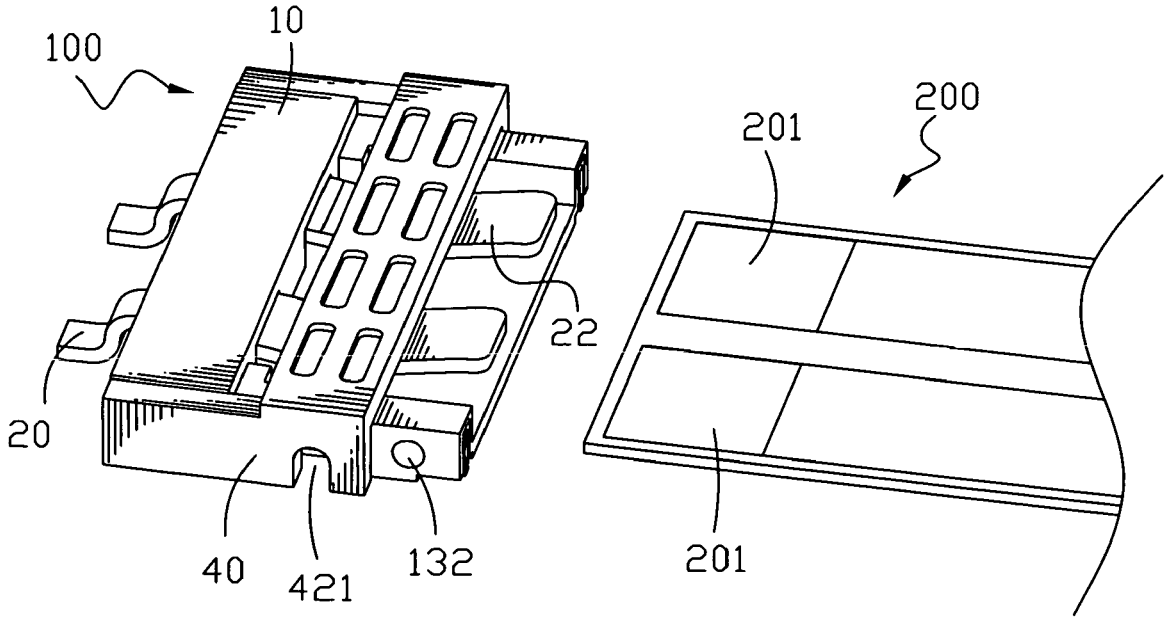
FIG. 5 is a perspective view of the flexible printed circuit connector and an FPC before the FPC is inserted thereinto.

Referring to FIGS. 1 to 4, in assembly, the electrical terminals 20 are mounted to the base insulator 10. The fixed portions 21 are received in the receiving grooves 121. The elastic contact portions 22 are located above the bottom board 11 of the base insulator 10 for allowing a flexible printed circuit (FPC) 200 (see in FIG. 5) to be inserted therebetween. The weld portions 23 are exposed out of the rear wall 12 for being soldered to a printed circuit board (not shown). The solder pads 30 are correspondingly embedded into the insertion cavities 131 of the sidewalls 13 for being soldered to the printed circuit board to further fix the flexible printed circuit connector 100 to the printed circuit board.

When the slide insulator 40 is to be assembled to the base insulator 10, the slide blocks 422 are buckled into the guide passages 133 of the sidewalls 13 and then slide forward along the guide passages 133 to enter in the corresponding sliding recesses 134 to finish the assembly of the slide insulator 40. In this case, the slide block 422 presses against a rear surface of the sliding recess 134. The cover 41 is positioned above the elastic contact portions 22 of the electrical terminals 20 but not press them.

Figure 6:
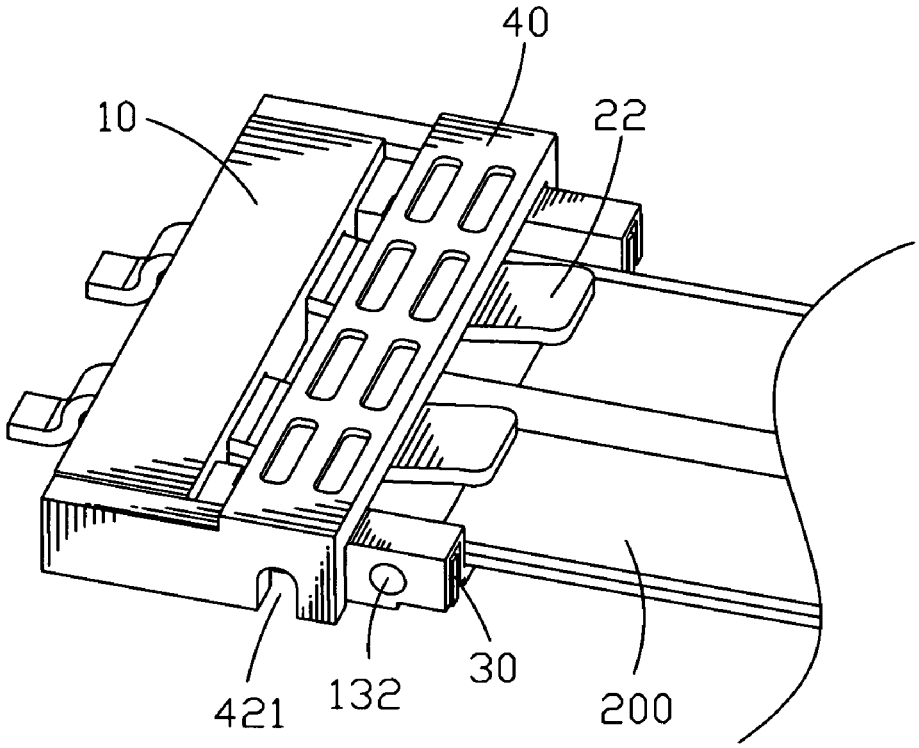
FIG. 6 is an assembly view showing the FPC of FIG. 5 inserted into the flexible printed circuit connector.
Figure 7:
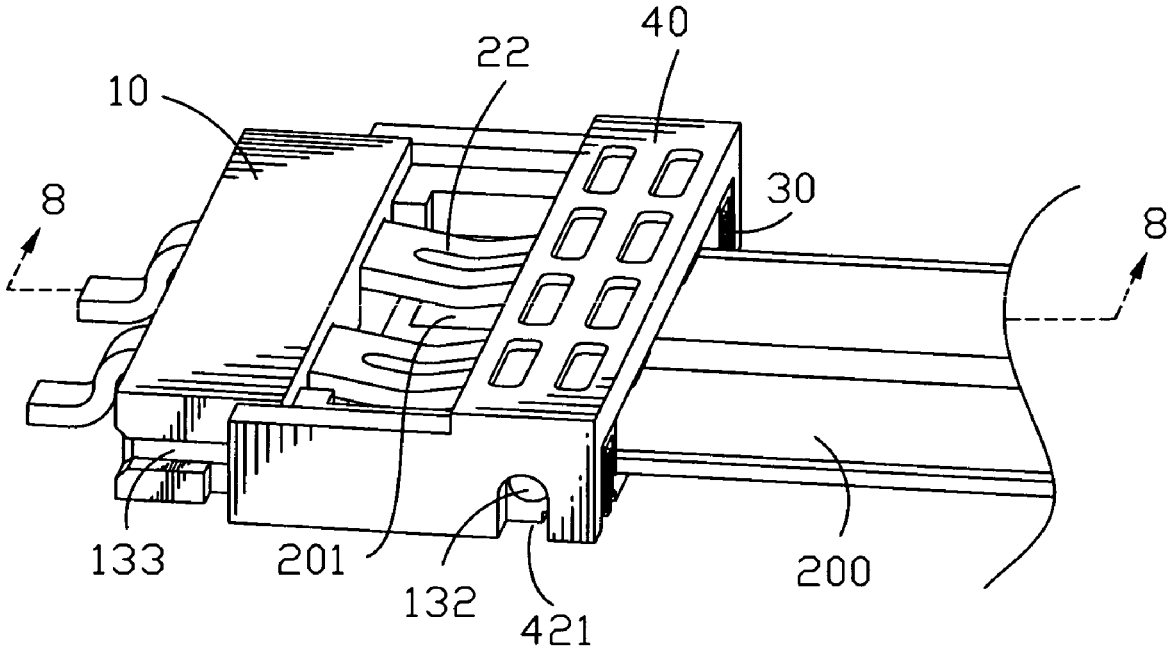
FIG. 7 is an assembly view of FIG. 6 with a slide insulator of the flexible printed circuit connector.
Figure 8:
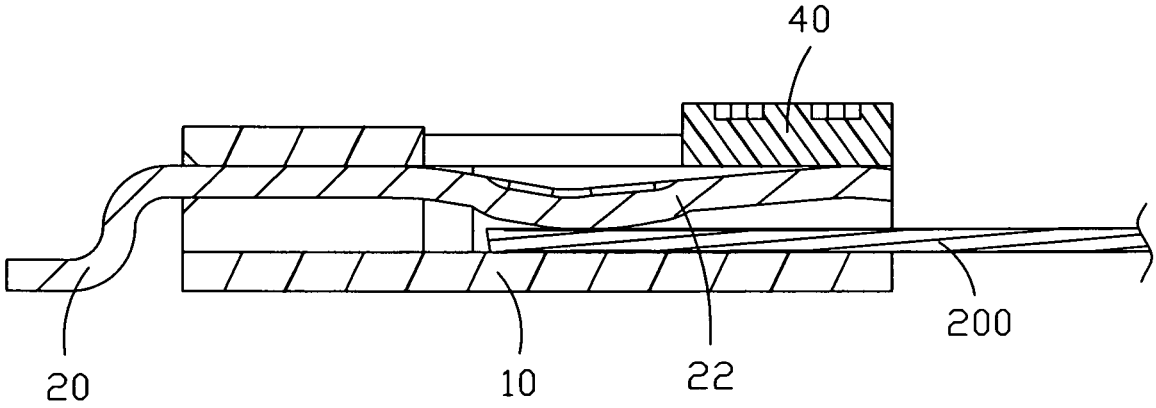
FIG. 8 shows a cross-sectional view of FIG. 7 taken along line 8-8.

FIGS. 5 to 8 shows an insertion of the FPC 200 into the flexible printed circuit connector 100. The FPC 200 defines two conductive pieces 201 at one end of a top surface thereof. Because the elastic contact portions 22 of the electrical terminals 20 are located above the bottom board 11 of the base insulator 10, the FPC 200 can easy to be inserted therebetween, as shown in FIG. 6. Then pull the slide insulator 40 to slide the slide blocks 422 forward along the sliding recesses 134. With the movement of the slide insulator 40, the projections 132 of the sidewalls 13 are engaged with the locking gaps 421 of the flanks 42 when the slide insulator slides relatively to the base insulation to a position where the cover is capable of pressing the elastic contact portions stably, as shown in FIG. 7. In this case, the cover 41 of the slide insulator 40 presses the elastic contact portions 22 downwardly to make the elastic contact portions 22 electrically connected with the conductive pieces 201 of the FPC 200, as shown in FIG. 8. Therefore, the FPC 200 is fixed between the elastic contact portions 22 and the bottom board 11 firmly, and the electrical connection between the elastic contact portions 22 and the conductive pieces 201 is stable.

As the above description, by virtue of the slide blocks 422 of the slide insulator 40 relatively sliding in the sliding recesses 134 of the base insulator 10, the cover 41 is capable of pressing the elastic contact portions 22 of the electrical terminals 20 downwardly to make the elastic contact portions 22 electrically connected with the conductive pieces 201 of the FPC 200. Thus, the FPC 200 is fixed between the elastic contact portions 22 and the bottom board firmly, and therefore, the electrical connection between the flexible printed circuit connector 100 and the FPC 200 is stable.

What is claimed is:

1. A connector for a flexible printed circuit, comprising:

a base insulator having a bottom board, a rear wall and two opposite sidewalls respectively extending upwardly from the bottom board, the rear wall defining plural receiving grooves, each of the sidewalls defining a sliding recess at an outside thereof;

a plurality of electrical terminals mounted in the corresponding receiving grooves, each of the electrical terminals having an elastic contact portion located above the bottom board for allowing the flexible printed circuit to be inserted therebetween; and a slide insulator having a cover and two flanks at two opposite sides of the cover, each of the flanks defining a slide block at an inner side thereof for relatively sliding in the sliding recess, the cover being capable of pressing the elastic contact portions downwardly to make the elastic contact portions stably electrically connected with the flexible printed circuit by a relative slide between the slide insulator and the base insulation, wherein each of the sidewalls of the base insulator defines a guide passage at a rear end thereof and communicating with the corresponding sliding recess, the slide blocks slide along the guide passages to enter in the corresponding sliding recesses.

2. The connector as claimed in claim 1, wherein each of the sidewalls of the base insulator has a projection protruding outside at a front portion thereof, each of the flanks of the slide insulator defines a locking gap at a front portion thereof for being engaged with the projection when the slide insulator slides relatively to the base insulation to a position where the cover is capable of pressing the elastic contact portions stably.

* * * * *